US005431401A

United States Patent [19]

Smith

[11] Patent Number: 5,431,401

[45] Date of Patent: Jul. 11, 1995

[54] GOLF PUTTER

[76] Inventor: Alvin Smith, 1301 W. 33rd St., Long Beach, Calif. 90810

[21] Appl. No.: 308,414

[22] Filed: Sep. 19, 1994

[51] Int. Cl.[6] ..... A63B 53/04

[52] U.S. Cl. ..... 273/167 R; 273/171; 273/167 G

[58] Field of Search ..... 273/77 A, 167 R, 168, 273/169, 175, 167 C, 167 D, 167 F, 167 G, 167 H, 171, 83 R, 67 A

[56] References Cited

U.S. PATENT DOCUMENTS

| | | | |
|---|---|---|---|
| D. 226,204 | 1/1973 | Indovina | 273/167 D |
| 3,720,410 | 3/1973 | Saytar | 273/168 |
| 3,851,880 | 12/1974 | Ritch | 273/168 |
| 4,811,949 | 3/1989 | Kobayashi | 273/171 |
| 4,896,885 | 1/1990 | Kajita et al. | 273/171 |
| 5,083,779 | 1/1992 | Ungermann | 273/171 |

*Primary Examiner*—Vincent Millin
*Assistant Examiner*—William M. Pierce
*Attorney, Agent, or Firm*—Charles H. Thomas

[57] ABSTRACT

A golf putter is provided with a putter head having a unique configuration. This configuration allows the putter shaft to be disposed in a substantially vertical orientation when the putter head impacts a golf ball. The putter head has a body with a flat, forwardly facing, vertically oriented striking face and a flat, horizontally oriented bottom face disposed substantially normal to the striking face. At the body of the putter a neck is formed that extends upwardly and rises above the level of the striking face of the putter body. The neck projects laterally from the body a distance of at least about one inch and above the level of the bottom face of the body a distance of at least about one inch. The neck of the putter head defines a shaft socket that is substantially perpendicular to the plane of the bottom face of the putter head. The shaft is thereby connected to and seated in the shaft socket. By utilizing the putter of the invention, a golfer is able to stand virtually upright in a relaxed position with arms tucked in against his or her sides. The putter can be swung in the manner of a pendulum. The curvature of the neck and the lateral inside surface of the body of the putter head provides clearance to allow the toe of the golfer's shoe to be positioned roughly adjacent to the ball and directly beneath the putter shaft.

18 Claims, 3 Drawing Sheets

GOLF PUTTER

BACKGROUND OF THE INVENTION

1. Field of the Invention

The present invention relates to golf putters and particularly the heads of golf putters utilized in the game of golf.

2. Description of the Prior Art

In the game of golf different types of golf clubs are utilized for making different shots. All golf clubs are formed with a straight, elongated shaft having a grip for grasping the shaft at one end and a golf club head at the opposite end.

The heads of golf clubs differ widely in configuration. Each golf club head is configured and designed to be used for a specific type of shot. For example, golf drivers are typically formed with relatively massive heads so as to maximize the transfer of momentum from the golf club head to the golf ball during a tee shot. Mashies and wedges are configured with impact faces that are inclined at significant angles relative to vertical when the face of the golf club head strikes the golf ball. Such a configuration is selected so as to achieve a relatively great height in order to lift a golf ball out of a sand trap or out of the rough. Putters, on the other hand, are utilized when the golf ball has reached the golf green.

A conventional golf putter employs a relatively flat putter head which resides in a near vertical disposition at the point of impact against a golf ball. Like other conventional golf clubs a conventional putter also is equipped with a shaft that is inclined upwardly at an angle relative to the substantially horizontal lower surface of the putter head at the position of impact against a golf ball. However, despite concentrated efforts on the part of numerous golf equipment designers, certain overall important considerations in golf putter design have been overlooked entirely.

SUMMARY OF THE INVENTION

A primary object of the present invention is to provide a golf putter that allows a golfer to maximize the accuracy of golf putts on a golfing green by utilizing features that have heretofore not been utilized in golf putter design. By constructing a golf putter according to the present invention, a golfer is provided with a golf club that aids the golfer in making golf putts with consistent and enhanced accuracy.

Another object of the present invention is to provide a golfer with a putter having a putter head that can be consistently swung so as to travel along a path lying entirely within a vertical plane. Unlike conventional golf putters, the shaft axis and shaft socket defined in the putter head are not oriented at an angle relative to the bottom face of the putter, but rather are oriented normal or perpendicular thereto. With a conventional putter the golfer attempts to swing the club such that the putter head travels in a path lying in a vertical plane. However, with putters of conventional design, the putter shaft must travel in a curved arc that resides at an angle relative to the plane of the path of travel of the putter head. This is because the shaft is joined to the putter head at an angle.

By constructing a golf putter such that a golf shaft axis and golf shaft socket defined in the putter head are perpendicular to the lower face of the putter head, and thus perpendicular to the generally horizontal playing surface, the putter shaft travels in a flat vertical plane, as does the putter head. The putter is thereby swung in the manner of a pendulum. This enhances the golfer's ability to strike the ball such that it will travel along a path closely perpendicular to the striking or impact face of the putter head.

Another object of the invention is to provide a golf putter which allows the golfer to sight vertically down the length of the putter shaft so as to view both the putter head and the ball, along a substantially vertical line of sight when making a put. In contrast, because of the angle of inclination of conventional putter shafts relative to the bottom surface of the putter heads, a golfer using a conventional putter must sight the ball and the putter head at an angle of inclination relative to vertical. A conventional putter, therefore, cannot be swung in the manner of a pendulum and the golfer cannot sight down the putter shaft vertically while performing a putt.

One of the design features that allows a golfer to sight vertically down the shaft on the golf club using a putter according to the present invention is the configuration of the neck of the putter head. The neck of the putter head, according to the invention, bends upwardly and inwardly toward the golfer and terminates in a vertically oriented socket for the golf club shaft. Moreover, this lateral offset provides a clearance beneath the golf club neck vertically downwardly from the shaft socket as the golf club meets the ball. The vertical clearance allows the golfer to position the body of the club adjacent to the ball and to position his or her feet closely adjacent to the path of travel of the body of the golf club head. The clearance beneath the putter neck forms a recess or cavity within which the golfer's shoe can reside because the golf head is swung in a pendulum-like manner. The recess also allows the putter shaft to be aligned vertically where the club meets the ball, rather than at an angle thereto as with conventional putters.

A further object of the invention is to provide a golf putter which allows the golfer to stand virtually upright while putting with practically no bending either at the knees or at the waist. The only bending necessary is the lowering of the golfer's neck. Thus, the golfer is able to assume a more relaxed position while putting and is far less likely to make a poor putt shot since the tendency of the body to quiver or tremble when bending or stooping at the waist or knees is avoided entirely.

A further object of the invention is to provide a golf putter which allows a golfer to perform a putting stroke while holding his or her elbows tight against the torso of the golfer's body. Thus, the golfer's elbows are supported by the sides of the golfer's body. This support provides the golfer with a greater degree of control of movement of his or her arms in performing the putting stroke. The feature further enhances the golfer's ability to consistently and accurately putt successfully.

In a broad aspect the present invention may be considered to a be a golf putter comprising a putter head having a body with a flat, forwardly facing striking surface that is substantially vertically oriented, upon impact with a golf ball, a flat horizontally oriented bottom face disposed substantially normal to the striking face, and a neck extending up from said body and rising up above the level of said striking face and projecting laterally therefrom a distance of at least about one inch and above the level of the bottom face a distance of at least about one inch. The neck defines therewithin a shaft socket that is substantially perpendicular to the plane of the bottom face. The putter also includes a shaft disposed to reside in a substantially vertical orientation at the position of impact of the putter head with a golf ball. The shaft is connected to and seated in the shaft socket.

In its preferred embodiment the putter head of the golf putter has a laterally inwardly facing surface rising from the bottom face. The laterally inwardly facing surface of the head, together with the neck, define a cavity beneath the putter head neck and adjacent the putter head body, This cavity is of a size and shape capable of accommodating placement of a golf shoe toe therewithin. The golfer is thereby able to stand extremely close to the golf ball so that the golfer can sight down the putter shaft to look vertically downwardly upon the ball without significant bending at the waist or stooping at the knees. The recess beneath the putter head neck allows the golf club head to travel along a path lying in a vertical plane, and for the golf club shaft to likewise travel in a path lying in a parallel vertical plane without striking the toe of the golfer's shoe.

Another feature of the preferred embodiment of the invention is an indicia on the top of the golf club head that aids the golfer in aligning the "sweet spot" or center of the striking face of the club head with the center of the golf ball. The shaft socket has a substantially vertical axis when the golf club head is at the point of impact with the striking face of the club head disposed against the golf ball. The striking face has a geometric center which lies in or is very close to a vertical plane passing through the center of mass of the club head and oriented perpendicular to the striking face. The shaft socket axis is preferably laterally offset from the center of the striking face a distance of between about one inch and about three inches. The bottom face of the putter head resides in a substantially horizontal plane when the putter head strikes the ball. The putter head neck has a vertical clearance therebeneath and above the plane of the bottom face at the moment of impact. This clearance is at least about one inch.

The body of the putter head has a transverse upper surface that intersects the striking face of the body of the putter head. An indicia is preferably placed on the upper surface of the putter head body. This indicia designates the location of a plane that is perpendicular to the striking face and which passes through the center of mass thereof and which is also perpendicular to the bottom face. This indicia preferably includes markings that bracket the location of the center of the striking face.

In an optional embodiment of the invention, the weight of the putter head may be varied. To this end the putter head may be constructed so as to define a hollow enclosure therewithin with an opening leading to the enclosure. A removable plug is provided that blocks the opening. A mass of selected weight may then be encapsulated within the enclosure. This mass may take the form of weighted metal discs, a selected number of which may be placed in the enclosure. A lighter weight packing material is provided to prevent the weights from shifting about within the enclosure during use of the golf putter.

In another broad aspect the invention may be defined as a golf putter head comprising a body formed with a substantially planar ball impact face, a substantially planar bottom face located adjacent to the ball impact face and oriented substantially perpendicular to the ball impact face, and a top surface located above the bottom face and adjacent to the ball impact face. The golf putter head is also formed with a putter neck extending away from the bottom face toward the top surface therebeyond in a direction parallel to the ball impact face and laterally away from the ball impact face and terminating in a golf club shaft socket oriented substantially perpendicular to the bottom face at a location above the top surface and laterally offset from the impact face.

In still another broad aspect the invention may be described with reference to an imaginary geometric volume of space with respect to which it is located. That is, the golf putter head is formed with a body residing within an imaginary rectangular prism shaped enclosure having opposing, mutually parallel planar top and bottom surfaces; opposing, mutually parallel planar front and back surfaces orthogonally disposed relative to the top and bottom surfaces; and opposing, mutually parallel planar inside and outside surfaces orthogonally disposed relative to the front, back, top, and bottom surfaces. The body has a ball impact face lying substantially in the front surface of this imaginary enclosure. It also has a bottom lying substantially in the bottom surface of the imaginary enclosure and an inner lateral side rising from the bottom and extending to the top surface and to the inside surface of the imaginary enclosure. The putter neck extends from the inner lateral side of the putter body beyond the top and inside surfaces of the imaginary enclosure. The neck defines a putter shaft axis located beyond the inside surface of the imaginary enclosure and oriented perpendicular to the planes of the top and bottom surfaces of the imaginary enclosure.

Considering the golf putter head with reference to this imaginary geometric figure, with reference to which the configuration of the putter head is described, all of the surfaces of the imaginary rectangular prism enclosure are preferably between about two and about three inches on a side. Preferably all of these surfaces are about two and one-half inches square.

The invention may be defined with greater clarity and particularity by reference to the accompanying drawings.

DESCRIPTION OF THE EMBODIMENT

Figure 1:
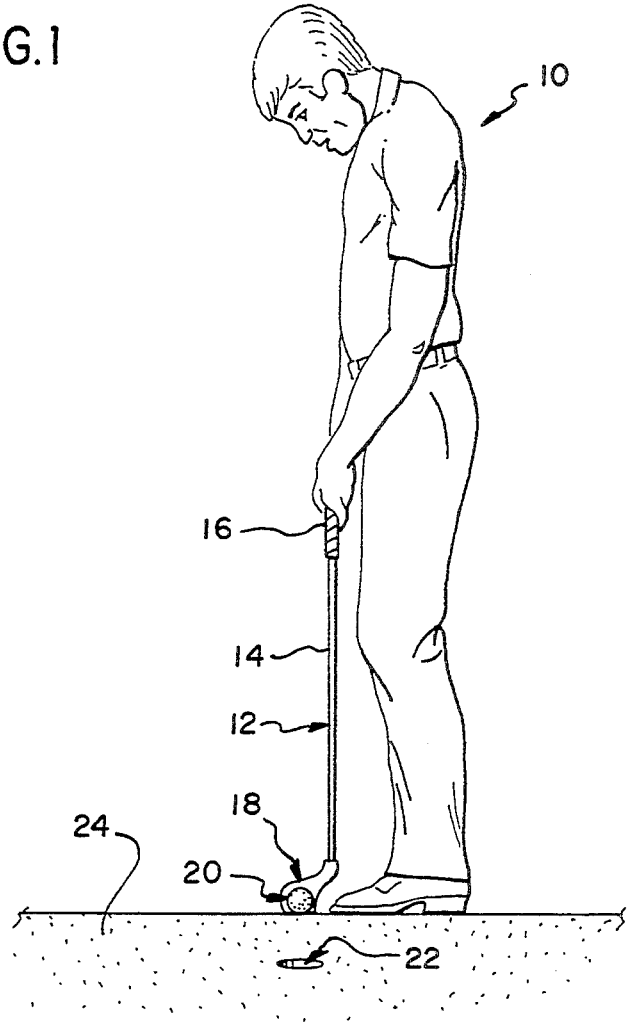
FIG. 1 is an elevational view illustrating the use of a putter according to the invention by a golfer.

FIG. 1 illustrates a golfer 10 utilizing a putter 12 according to the invention. The putter 12 is constructed with an elongated, straight shaft 14 having a grip 16 at its upper extremity and a putter head 18 at its lower extremity. The golfer 10 is shown addressing a golf ball 20 while holding the putter 12 in the position in which the putter head 18 makes impact against the golf ball 20 to putt the ball 20 toward the hole 22 in the green 24.

The details of construction of the golf club head 18 are illustrated in FIGS. 2–8. The golf club head 18 includes a generally block-shaped body 26 rounded at its corners, and a curved, relatively slender neck 28 rising therefrom. The ball impact face 30 is of a generally rectangular shape and is approximately two inches in width as viewed in FIGS. 2, 3, and 6, and approximately one and one-half inches in height, as viewed in FIGS. 2, 4, and 5. As best illustrated in FIGS. 3–6, the putter head body 26 is formed with a substantially planar ball impact face 30. At the moment of impact against the golf ball 20, the ball impact or striking face 30 resides at a substantially vertical orientation.

Figure 3:
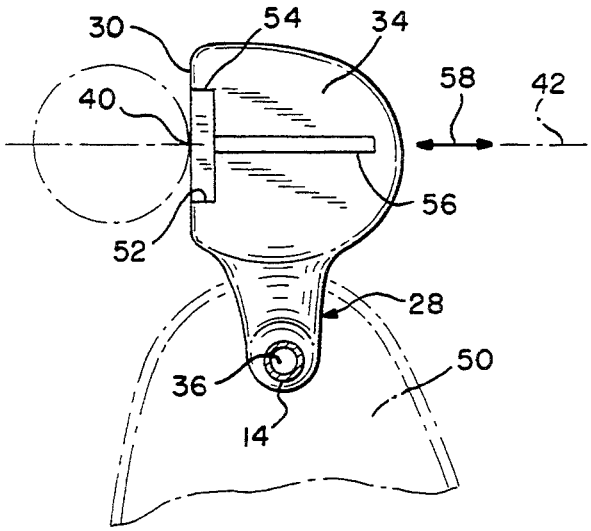
FIG. 3 is an enlarged top plan view of the golf club head of FIG. 2.
Figure 4:
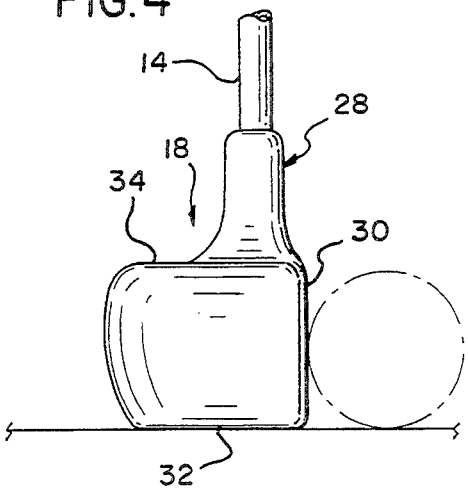
FIG. 4 is an enlarged elevational view of the golf putter head of FIG. 2 as seen from a position facing the golfer of FIG. 1.
Figure 5:
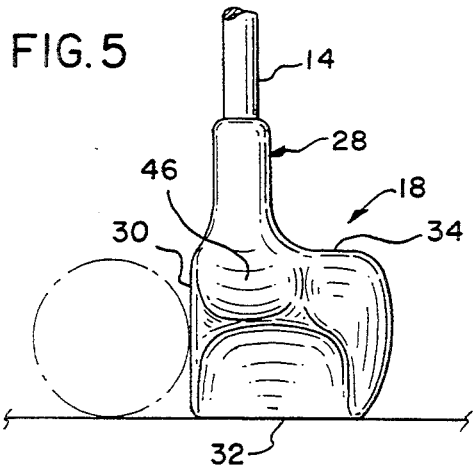
FIG. 5 is an enlarged elevational view of the golf putter head of FIG. 2 as seen from a position behind the golfer of FIG. 1.

The putter head body 26 also has a substantially planar bottom face 32 located adjacent to the ball impact face 30 and oriented substantially perpendicular thereto, as best illustrated in FIGS. 4 and 5. The bottom face 32 is shaped as a generally "D-shaped" flat, surface area with the same width of two and a half inches as the ball impact face 30 as measured along the edge of intersection therewith, and a maximum fore and aft depth of about two and one-half inches as well, as measured in the plane of FIG. 6. At the moment of impact of the golf club head 18 against the golf ball 20, as shown in FIGS. 1–7, the bottom face 32 is at a horizontal orientation.

The golf putter body 26 also has a top surface 34 that is likewise substantially flat. The top surface 34 is located above the bottom face 32 and adjacent to the ball impact face 30, as best illustrated in FIG. 4. The top surface 34 is preferably slightly larger than the bottom surface 32, but also has a generally "D-shaped" surface area. The top surface area 34 is about two and one-half inches in lateral width as measured along the line of intersection with the ball impact face 30, and about two and five-eighths inches in fore and aft depth, as it is viewed in FIGS. 3 and 4.

Figure 2:
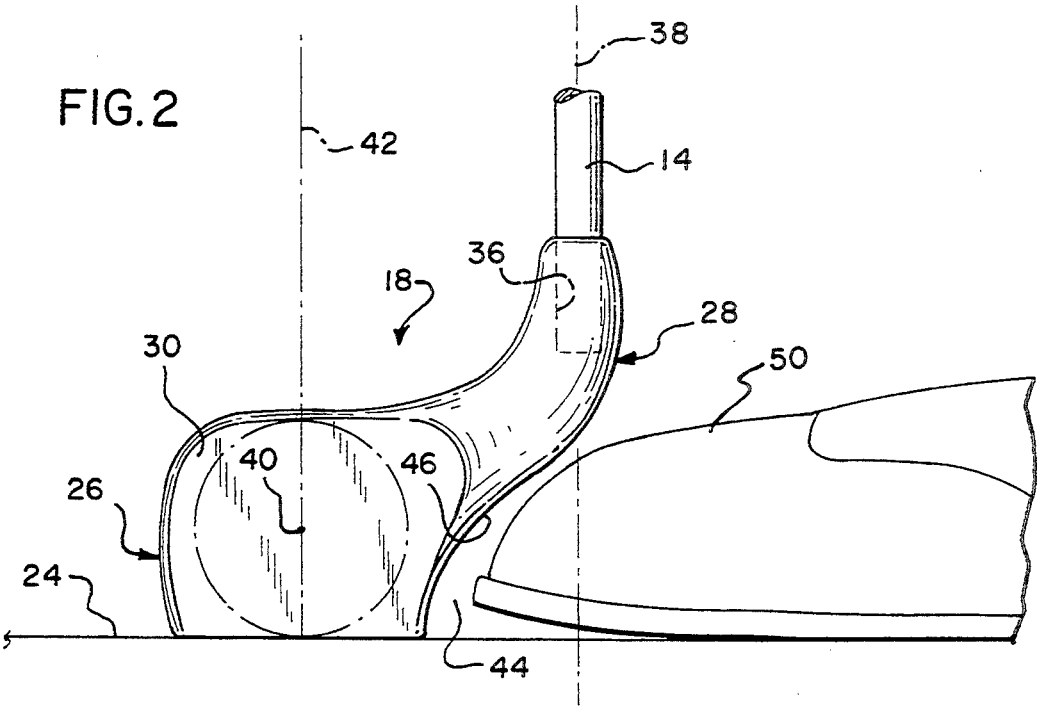
FIG. 2 is an enlarged elevational detail showing the golf putter head of FIG. 1.

The putter neck 28 is of a generally gooseneck configuration, as best viewed in FIG. 2. The putter neck 28 extends away from the bottom surface 32 of the putter body 26 and toward the top surface 34 thereof. The neck 28 extends upwardly beyond the top surface 34 in a direction parallel to the ball impact face 30, as best illustrated in in FIGS. 4 and 5. The putter head neck 28 extends laterally away from the ball impact face 30 and terminates at a golf club shaft socket indicated at 36 in FIG. 2.

The golf club shaft socket 36 is of circular cross section and extends down into the structure of the neck 28 from the top thereof. The golf club shaft socket 36 has a linear axis 38 and is oriented substantially perpendicular to the plane of the bottom face 32 at a location above the top surface 34. The shaft socket 36 is laterally offset from the impact face 30 as shown in FIG. 2. The golf club shaft 14 is connected to and seated in the shaft socket 36 in a conventional manner.

As best illustrated in FIGS. 1–3, the impact face 30 has a geometric center indicated at 40. The impact face geometric center 40 lies in a vertical plane 42 at the point of proper impact against the golf ball 20. The plane 42 is perpendicular to both the impact face 30 and the bottom face 32 and passes through the center of mass of the club head 18.

As shown in FIG. 2, the shaft socket axis 38 is laterally offset from the impact face center 40 and the vertical plane 42 in which it resides at a spaced distance. This distance is preferably between about one and three inches.

As shown in FIGS. 1–3, the putter head neck 28 forms a clearance or recessed area 44 located beneath the socket 36. This area 44 is formed beneath the convex surface of the neck 28 and adjacent the curved laterally inwardly facing surface 46 of the putter head body 26. Together the neck 28 and the laterally inwardly facing surface 46 of the putter head body 26 define the cavity 44 beneath the putter head neck 28 and adjacent the putter head body 26. The vertical depth of the recess 44 as measured from the underside of the putter head neck 28 along the shaft axis 38 and above the plane of the bottom face 34 is at least about one inch.

By configuring the golf putter head 18 in this manner, the golfer can stand closely adjacent to the golf ball 20, so as to look vertically down the shaft 14 without the necessity for bending at either the knees or the waist. Quite to the contrary, the golfer 10 is able to stand virtually straight with just his head bent over. Virtually all bending is from the neck up.

The cavity 44 is of a size and shape capable of accommodating placement of the golf shoe toe 50 of a golf shoe worn by the golfer 10 therewithin. The cavity or recess 44 allows the golfer 10 to swing the club 12 in a pendulum-like manner, wherein both the golf putter shaft 14 and the golf club putter head 18 travel in vertical planes. The toe 50 of the golfer's shoe fits into the space 44 beneath the underside of the neck 28 and above the plane of the bottom face 34 of the putter head body 26.

As shown in FIG. 3, the transverse upper surface 34 of the putter head 36 has indicia thereon that designate the location of the vertical plane 42. The vertical plane 42 is perpendicular to the impact or striking face 30 and passes through the center 40 thereof. The indicia may take many different forms, but preferably includes marks 52 and 54 that are laterally separated from each other if measured parallel to the ball impact face 30. The marks 52 and 54 are located equidistant from the center 40 of the ball impact face 30. The markings 52 and 54 thereby bracket the location of the center 40 and define the "sweet spot" of the ball impact face 30. In the embodiment illustrated the indicia also includes a longer mark 56 that lies along the plane 42 passing through the center 40 of the impact face 30.

By providing the indicia 52–56, the golfer is provided with markings on the putter head 26 that aid the golfer in properly lining up the putter head 26 with the ball 20. This aids the golfer 10 in consistently and accurately swinging the putter 12 along a true vertical plane in a pendulum-like manner, as indicated by the directional lines 58 in FIG. 3. The golfer 10 is thereby able to consistently strike the golf ball 20 squarely upon the center 40 of the ball impact face 30.

The structural features of the putter head 26 may also be described with reference to a volume defined by an imaginary enclosure 60, illustrated in FIG. 8. This enclosure 60 is shaped as a rectangular prism. The enclosure 60 has opposing mutually parallel planar top and bottom surfaces 62 and 64, opposing mutually parallel planar front and back surfaces 66 and 68 orthogonally disposed to the top and bottom surfaces 62 and 64, and opposing mutually parallel planar inside and outside surfaces 70 and 72, respectively. The inside surface 70 and the outside surface 72 are also orthogonally disposed relative to the front surface 66, the back surface 68, the top surface 62, and the bottom surface 64.

Figure 8:
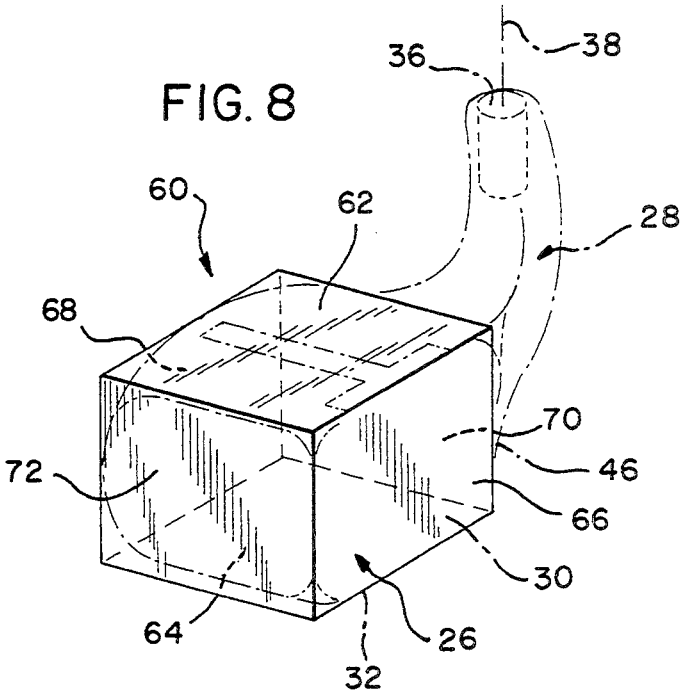
FIG. 8 is a perspective view illustrating an imaginary enclosure in the form of a rectangular prism with reference to which the structure of the golf club head of FIG. 2 may be described.

As illustrated in phantom in FIG. 8, the putter head body 26 has a ball impact face 30 lying substantially within the front surface 66 of the imaginary enclosure 60, and a bottom 32 lying substantially within the bottom surface 64 of the imaginary enclosure 60. The inner, lateral side 46 of the putter body 26 rises from the bottom 32 and extends to the top surface 62 and to the inside surface 70 of the imaginary enclosure 60. The putter neck 28 extends from the inner lateral side 46 of the putter body 26, and beyond the top surface 62 and beyond the inside surface 70 of the imaginary enclosure 60.

As noted before, the neck 26 defines a putter shaft socket 36 and a putter shaft axis 38. The putter shaft axis 38 is located beyond the inside surface 70 of the imaginary enclosure 60, in the direction of the golfer 10. The putter shaft axis 38 is oriented perpendicular to the planes of the top and bottom surfaces 62 and 64 of the imaginary enclosure 60.

All of the surfaces 62–72 of the imaginary rectangular prism shaped enclosure 60 are between about two and about three inches on a side. Preferably, each of these surfaces is between about two and a half and two and five-eighths inches on a side.

Figure 6:
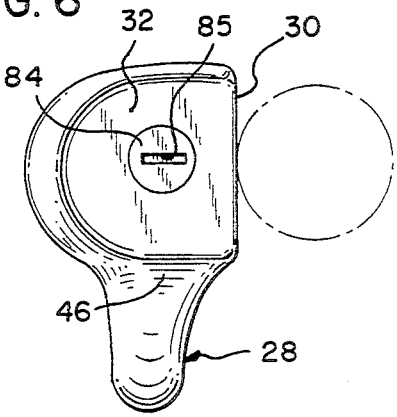
FIG. 6 is a bottom plan view of the golf putter head of FIG. 2.
Figure 7:
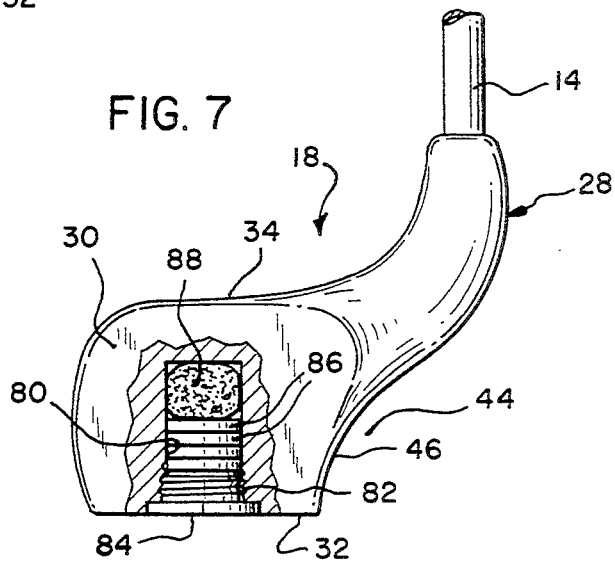
FIG. 7 is a side elevational view, partially broken away, illustrating the construction of the interior of the golf club head of FIG. 2.

FIGS. 6 and 7 illustrate an optional structural feature of the invention. Different golfers at times prefer putters having heads of different weights. Indeed, even the same golfer will sometimes prefer a putter head of different weight depending upon atmospheric conditions, condition of the grass on a green, and other factors of personal preference. To this end the golf putter head 18 of the invention may be provided with a hollow enclosure in the form of a blind, cylindrical bore 80 formed in the surface 32 of the golf putter body 26. The bore 80 forms a hollow enclosure within the golf putter body 26 and is internally tapped. The bore 80 forms a shoulder at its opening 82 in the bottom face 32 of the putter body 26. The opening 82 provides an entrance to the enclosure.

An externally threaded male plug 84 is provided and is threadably engaged with the opening 82 so as to seat on the shoulder defined therein. The plug 84 is removable and is secured in the opening 82. When fully engaged the exposed, circular surface of the plug 84 resides flat in coplanar relationship with the bottom face 32 of the putter head body 26 as illustrated in FIG. 7. The plug 84 may be threaded and unthreaded relative to the opening 82 by means of a slot 85 in its exposed face. The slot 85 will accommodate the blade of a screw driver or another implement for turning the plug 84 to advance or withdraw it relative to the opening 82.

Within the bore 80 the golf putter head 18 is provided with a mass of selected weight formed by any chosen number of disc-shaped weights 86. The disc-shaped weights 86 have a diameter that allows them to just fit within the chamber formed by the bore 80. The disks 86 are each of a predetermined weight. The diameter of the disc-shaped weights 86 is great enough so that they will not shift laterally within the bore 80. A compressible, lightweight packing material, such as a wad of cotton 88 is normally disposed in the blind end of the bore 80 so as to prevent the disc-shaped weights 86 from moving longitudinally within the bore 80.

A user may insert or withdraw as many weights 86 as desired to increase or decrease the weight of the putter head 18. To increase the weight of the putter head 18, and thus the momentum the head will have during a stroke, a golfer will place more of the weights 86 within the chamber 80. Conversely, to reduce the weight of the putter head 18 some of the weights 86 may be removed from the chamber 80. The packing material 88 is maintained in the chamber 80 to ensure that the weights 86 will not move once installed therein. Any selected number of discs 86 may be located within the enclosure 80.

Figure 9:
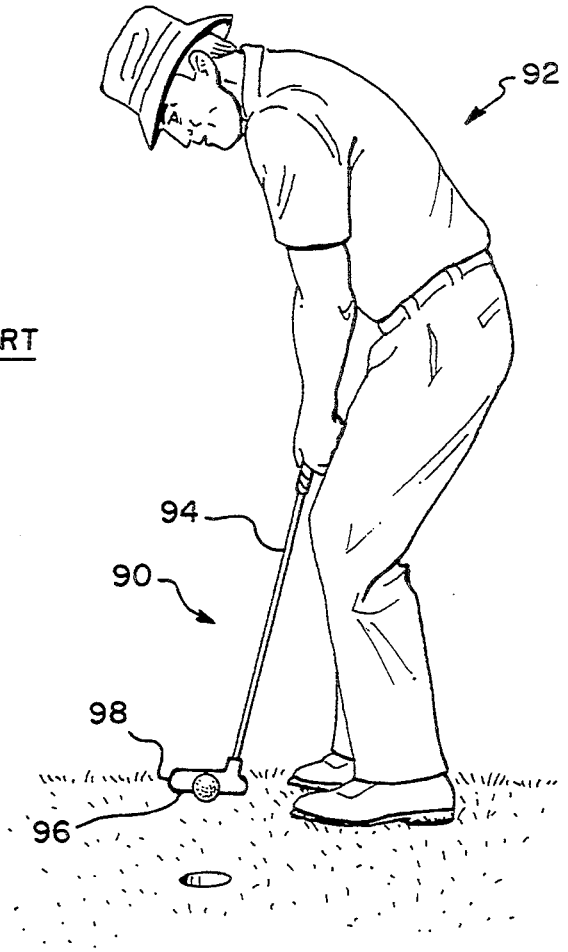
FIG. 9 PRIOR ART
FIG. 9 is an elevational view illustrating a golfer utilizing a conventional putter, in contradistinction to the use of the putter of the invention depicted in FIG. 1.

The advantages of the putter 12 of the invention are readily apparent by comparing its use by a golfer 10, shown in FIG. 1, with the use of a conventional putter 90 by a golfer 92 as shown in FIG. 9. As illustrated in FIG. 9, the putter 90 has a shaft 94 that extends upwardly at an inclination of about 75 degrees relative to the plane of the bottom surface 96 of the putter head 98. Thus, in order to look vertically down on the ball 20, the golfer 92 must both flex his knees and also bend over at the waist. By necessity the golfer 92 must hold his elbows out away from contact with his body. The bending and stooping required to assume the stance in which the golfer 92 is able to address the ball 20 toward hole 22 requires the golfer 92 to contort his body to a strained position. This very typically leads to a certain amount of unsteadiness that causes a slight trembling or quivering. This often results in a misdirected shot. Furthermore, since the elbows of the golfer 94 cannot be tucked in close against his body, the plane of movement of the golfer's arms is more likely to be errant, and there is a considerable likelihood that the putt will go awry.

In contrast, the golfer 10 utilizing the putter 12 according to the invention is able to stand virtually straight without bending either his knees or his waist as shown in FIG. 1. Only the neck of the golfer 10 is bent. Moreover, the golfer 10 is able to look vertically downwardly and sight the ball 20 vertically along the length of the golf club shaft 14. The elbows of the golfer 10 are tucked in and stabilized against his sides. The golfer 10 thereupon swings the putter 12 almost solely using his lower arms. Moreover, the swing of the putter 12 is more like the swing of a pendulum in a vertical plane. The golfer 10, by putting from the more relaxed position depicted in FIG. 1, is less likely to make a misdirected putt than a golfer of equal skill using a conventional putter as illustrated in FIG. 9.

Undoubtedly, numerous variations and modifications of the invention will become readily apparent to those familiar with golf clubs and their characteristics. Accordingly, the scope of the invention should nob be construed as limited to this specific embodiment illustrated.

I claim:

1. A golf putter comprising a putter head having a body with a flat, forwardly facing, striking face that is substantially vertically oriented upon impact with a golf ball, a flat horizontally oriented bottom face disposed substantially normal to said striking face, and a neck extending from said body and rising up above the level of said striking face and projecting laterally therefrom a distance of at least about one inch and above the level of said bottom face a distance of at least about one inch and which defines therewithin a shaft socket substantially perpendicular to the plane of said bottom face, and a shaft disposed to reside in a substantially vertical orientation at impact of said putter head with a golf ball, wherein said shaft is connected to and seated in said shaft socket.

2. A golf putter according to claim 1 wherein said putter head has a laterally inwardly facing surface rising from said bottom face, and said laterally inwardly facing surface of said head, together with said neck, defines a cavity beneath said putter head neck, and adjacent said putter head body of a size and shape capable of accommodating placement of a golf shoe toe therewithin.

3. A golf putter according to claim 1 wherein said shaft socket has an axis that is substantially vertical upon impact of said putter head with a golf ball and said striking face has a center, and said shaft socket axis is laterally offset from said center of said striking face a distance of between about one inch and about three inches, and said bottom face resides in a substantially horizontal plane, and said putter head neck has a vertical clearance therebeneath above said plane of said bottom face of at least about one inch.

4. A golf putter according to claim 3 wherein said body of said putter head has a transverse upper surface that intersects said striking face and further comprising indicia on said upper surface designating the location of a plane that is perpendicular to both said striking face and said bottom face and passes through said center of said striking face.

5. A golf putter according to claim 4 wherein said indicia includes markings that bracket the location of said center of said striking face.

6. A golf putter according to claim 1 wherein said putter head defines a hollow enclosure therewithin with an opening thereto and a removable plug that blocks said opening, and further comprising a mass of a selected weight encapsulated within said enclosure.

7. A golf putter head comprising a body formed with a substantially planar ball impact face, a substantially planar bottom face located adjacent to said ball impact face and oriented substantially perpendicular to said ball impact face, a top surface located above said bottom face and adjacent to said ball impact face, and a putter neck extending away from said bottom face toward said top surface and therebeyond in a direction parallel to said ball impact face and laterally away from said ball impact face and terminating at a golf club shaft socket oriented substantially perpendicular to said bottom face at a location above said top surface and laterally offset from said impact face.

8. A golf putter head according to claim 7 wherein said socket has an axis and said impact face has a center, and said socket axis is laterally offset from said impact face center a distance of between about one inch and three inches.

9. A golf putter head according to claim 8 wherein said neck forms a clearance beneath said socket of a size large enough to accommodate the toe of a golf shoe therebeneath and above the plane of said bottom face.

10. A golf putter head according to claim 9 further comprising an indicia on said top surface denoting the position of said center of said impact face.

11. A golf putter head according to claim 7 wherein said body defines a hollow enclosure therewithin and an opening to said enclosure, and further comprising a selected number of objects of predetermined weight located within said enclosure and a removable plug secured in said opening.

12. A golf putter head formed with a body residing within an imaginary enclosure shaped as a rectangular prism and having opposing, mutually parallel planar top and bottom surfaces, opposing, mutually parallel planar front and back surfaces orthogonally disposed relative to said top and bottom surfaces, and opposing, mutually parallel planar inside and outside surfaces orthogonally disposed relative to said front, back, top, and bottom surface, wherein said body has a ball impact face lying substantially within said front surface of said imaginary enclosure, a bottom lying substantially within said bottom surface of said imaginary enclosure and an inner lateral side rising from said bottom and extending to said top surface and to said inside surface of said imaginary enclosure, and a putter neck extending from said inner lateral side of said putter body beyond said top and inside surfaces of said imaginary enclosure and defining a putter shaft axis located beyond said inside surface of said imaginary enclosure and oriented perpendicular to the planes of said top and bottom surfaces of said imaginary enclosure.

13. A golf putter head according to claim 12 wherein all of said surfaces of said imaginary enclosure are between about two and about three inches on a side.

14. A golf putter head according to claim 13 wherein all of said surfaces of said imaginary enclosure are about two and one-half inches square.

15. A golf putter head according to claim 12 wherein said putter shaft axis is laterally offset from said inside face of said imaginary enclosure by a distance of between about one and two inches.

16. A golf putter head according to claim 15 wherein said putter neck defines a recess of a size large enough to receive the toe of a golf shoe therewithin beneath said neck and above said bottom of said putter head and adjacent said inside lateral side of said putter body.

17. A golf putter head according to claim 16 wherein said ball impact face has a center and said putter head has a top that resides substantially in said top surface of said imaginary enclosure and intersects said ball impact face, and further comprising indicia on said top indicative of the location of said center of said ball impact face.

18. A golf putter head according to claim 17 wherein said body of said putter head defines a hollow enclosure therewithin with an opening leading thereto, and further comprising a mass of selected weight disposed in said hollow enclosure and a plug sealing said opening.

* * * * *